US005189844A

United States Patent [19]

Swarden et al.

[11] Patent Number: 5,189,844

[45] Date of Patent: Mar. 2, 1993

[54] FLUID DRIVEN TOOL CONTROL DEVICE

[75] Inventors: Michael C. Swarden, Cambridge; Walter L. Brassert, Belmont, both of Mass.

[73] Assignee: Northern Research & Engineering Corp., Woburn, Mass.

[21] Appl. No.: 813,467

[22] Filed: Dec. 26, 1991

[51] Int. Cl.[5] ..... B24B 49/00

[52] U.S. Cl. ..... 51/165.9; 51/170 R; 173/168

[58] Field of Search ..... 51/165.9, 170 R, 170 PT, 51/170 TL, 170 MT; 173/168, 169, 170

[56] References Cited

U.S. PATENT DOCUMENTS

| | | | |
|---|---|---|---|
| 3,295,262 | 1/1967 | Brown | 51/170 R |
| 4,125,968 | 11/1978 | Mackay | 51/170 R |
| 4,479,553 | 10/1984 | Virgili | 173/168 |
| 4,683,682 | 8/1987 | Pennison | 51/170 R |

*Primary Examiner*—M. Rachuba
*Attorney, Agent, or Firm*—Michael H. Minns

[57] ABSTRACT

A compressed air driven hand-held tool including a body adapted to be grasped by the hand, an air inlet adapted to be connected to an air supply hose, an air motor driving an output shaft carrying a work implement, and a throttle valve controlling the supply of air to the motor. A spring acts on a valve piston to urge the throttle valve to a closed position. The piston is acted on by air pressure to allow the throttle valve to open. A control chamber in the tool body receives air pressure from the air supply through a restricting orifice at a controlled rate, has an air outlet adapted to closed by the hand of the operator when grasping the tool body and is connected to the air pressure side of the valve piston. When uncovered, the air outlet exhausts the air in the control chamber at a rate to maintain the pressure in the control chamber at an atmospheric level. When covered by the operator's hand, the air pressure in the control chamber rises and acts on the valve piston to open the throttle valve. A second embodiment includes a two-stage valve circuit for controlling the air motor.

12 Claims, 2 Drawing Sheets

FLUID DRIVEN TOOL CONTROL DEVICE

BACKGROUND OF THE INVENTION

This invention relates generally to controls for pressurized fluid driven tools and more particularly to controls intended to be operated by the hand of an operator using a fluid driven tool.

Conventional hand-operated controls for fluid driven tools use a pivoted level which is pressed against the body or casing of the tool to start the tool and released to stop the tool. Maintaining this lever depressed during operation of the tool can become tiring to the hand of an operator. One advantage of this particular design of control is that the tool is immediately stopped if the tool is dropped or otherwise released from the hand of the operator. In order to avoid the discomfort of maintaining the control lever depressed during the operation of the tool, it is common for operators to tape or otherwise tie down the control to maintain it in a continuous open position, whether or not the tool remains in the hand of the operator. This result is objectionable because it creates the unsafe condition of the tool control failing to stop the tool when it is dropped or otherwise released by the hand of the operator.

The foregoing illustrates limitations known to exist in current controls used in fluid driven tools. It is apparent that it would be advantageous to provide a alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid driven tool having a control device comprising a tool body including an inlet for driving fluid, a throttle valve in said tool body for controlling the flow of driving fluid to a tool motor and having a normally closed position, means responsive to an increase of fluid pressure for opening said valve to cause driving fluid to flow to said tool motor, a chamber in said body, an opening in said body for venting said chamber to the atmosphere and located where it is closed by the hand of an operator normally grasping the tool body during operation, means for connecting said chamber to said valve opening means for the pressure in said chamber to cause said valve opening means to open said valve and means for applying fluid pressure to said chamber at a low pressure wherein the pressure in said chamber can remain at substantially atmospheric pressure when said opening is uncovered and will rise to a pressure above atmospheric when said opening is covered by the hand of an operator thereby causing the valve opening means to open the valve in said body for allowing driving fluid to flow to said tool motor.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
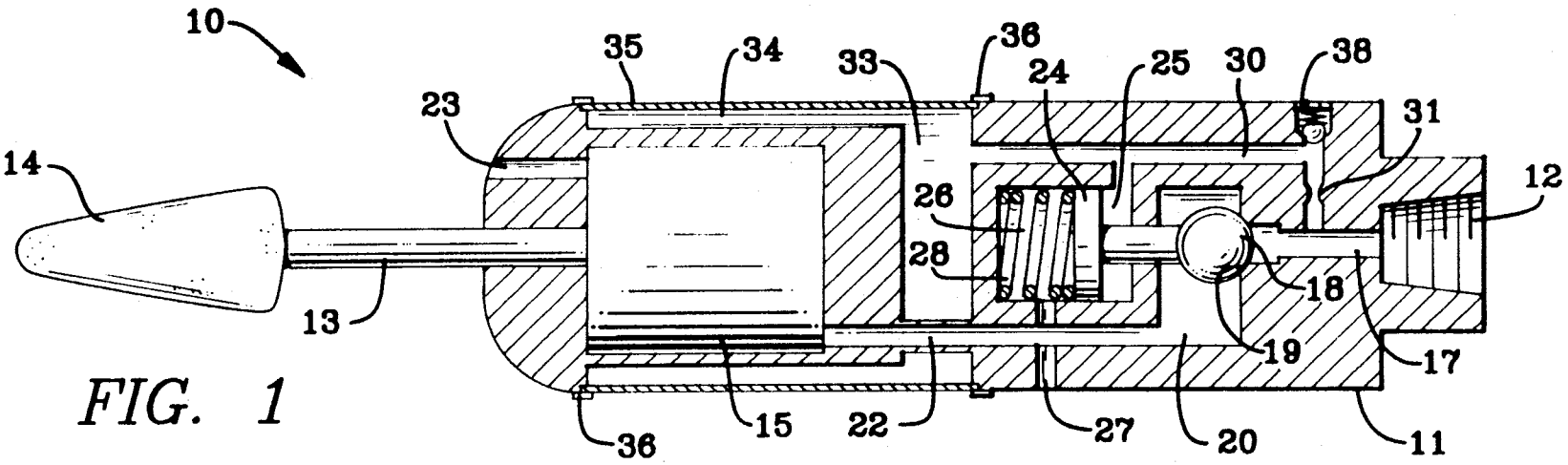
FIG. 1 is a simplified cross section of one embodiment of a hand-held pneumatic grinder incorporating the control device of this invention.

The invention is described and illustrated in connection with a hand-held pneumatically-operated grinding tool 10 including a tool body 11 having a air inlet 12 at its rear end and a rotary shaft 13 at its front end carrying a working implement 14, such as, for example, a grinding ball or wheel. The rotary shaft 13 is connected to and driven by an air motor 15 contained in the forward end of the tool body 11. It should be understood that the invention is intended for use with all hand-held pneumatic tools, even though it is described and illustrated installed in the grinding tool 10.

The air inlet 12 at the rear of the tool 10 is threaded and adapted to be connected to an air hose (not shown) supplying compressed air to the tool 10 in a conventional manner. The inlet 12 connects to an inlet passage 17 contained in the tool body 11 and extending to a ball-type throttle valve 18 adapted to engage a valve seat 19 located at the end of the passage 17. The throttle valve 18 is located in a valve chamber 20 where it can move between a position engaging the valve seat 19, closing the inlet passage 17, and an open position, wherein it opens the inlet passage 17. The valve chamber 20 is connected to a motor passage 22 leading to the air motor 15. Compressed air entering the chamber 20 through the open valve 18 flows to the air motor 15 through the motor passage 22. Fluid is exhausted from the air motor 15 through the exhaust passage 23, shown as extending from the air motor 15 and opening through the front end of the tool body 11 adjacent the rotary shaft 13.

The throttle valve 18 is held against the valve seat 19 by a piston 24 sliding in a closed space and connected to the valve 18. The piston 24 divides the closed space into a pressure chamber 25 located on the valve side of the piston 24 and a spring chamber 26 located on the opposite side of the piston 24. The piston 24 is biased toward the valve seat 19 by a compression spring 28 contained in the spring chamber 26. The spring 28 urges the piston 24 and the valve 18 toward the normally closed position of the throttle valve 1 wherein the air is cut off from the motor 15. The spring chamber 26 is vented to the atmosphere by the vent passage 27 leading from the chamber 26 to the outer surface of the tool body 11, thereby preventing pressure from rising in the chamber 26. A pressure rise in the chamber 26 would be undesirable because it would uncontrollably vary the forces acting on the piston 24.

A bleed passage 30 extends from the inlet passage 17 to the pressure chamber 25 and contains an orifice 31 sized to allow the air to flow from the inlet passage 17 at a low controlled rate. The bleed passage 30 opens into the pressure chamber 25 opposite the side of the piston 24 acted on by the spring 28, whereby pressure in the bleed passage 30 acts in opposition to the spring 28. The passage 30 also extends to a control chamber 33 enclosed in the tool body 11 and having an outlet port 34 for allowing the air pressure within the control chamber 33 to escape to the atmosphere. The orifice 31 is sized to bleed enough air pressure to the control chamber 33 for the pressure to rise substantially when the outlet port 34 is closed and for the air pressure in the control chamber 33 to drop to atmospheric pressure when the outlet port 34 is open.

The outlet port 3 is located in the outer surface of the tool body 11 wherein it is normally closed by the hand of an operator using the tool 10. When the tool 10 is grasped by the operator and the outlet port 34 is covered by the operator's hand, the air being bled into the control chamber 33 is restricted from escaping and the pressure in the chamber 33 rises causing the pressure on the valve operating piston 24 to also rise and urge the valve piston 24 and attached throttle valve 18 in a valve-opening direction. Simultaneously, pressure in the inlet passage 17 urges the throttle valve 18 in the valve-opening direction. The result of these forces acting on both the piston 24 and the throttle valve 18 causes the throttle valve 18 to move away from its seat 19, thereby opening the valve 18 and allowing air pressure to flow to the motor 15.

When the operator desires for the tool motor 15 to stop, he releases his or her grasp on the tool body 11 sufficiently for the air pressure in the control chamber 33 to escape through the outlet port 34 causing the pressure in the control chamber 33 to drop. The pressure in the piston chamber 25 also drops accordingly and allows the piston 24 to move the throttle valve 18 into its closed position, wherein the throttle valve 18 engages the valve seat 19 to bar the air pressure from flowing to the motor 15. The tool 10 remains in this condition until the outlet port 34 is again covered to cause the air pressure to rise in the control chamber 33.

The outlet port 34 is illustrated as covered by a screen 35 which will keep unwanted objects from entering the outlet port 34, either from the inside or the outside of the body 11, and may be more comfortable for the operator to grasp than an open port. The surface of the tool body 11 further carries spacer rings 36 circling the body 11 and spaced o opposite sides of the outlet port 34. These rings 36 act as spacers to support the tool away from a surface when resting on such surface in order to avoid such surface from blocking the outlet port 34 thereby causing the pressure to rise in the control chamber 33 and opening the throttle valve 18.

A pressure limiting port 38 is provided in the tool body 11 for venting pressure from the bleed passage 30 to limit the rise of pressure in the bleed passage to a maximum pressure which will prevent the pressure in the control chamber 33 from rising above a desired range of pressures. The pressure limiting port 38 can contain a valve that opens above a predetermined pressure or, alternately, it can contain a bleed passage providing a predetermined resistance to the escape of fluid pressure.

This form of control device for a pneumatic tool should be comfortable for an operator to use because it eliminates the pressure on the hand caused by the prior art lever type of throttle valve. Making the control device comfortable should eliminate the likelihood of an operator taping the throttle valve open, as was the case with prior controls. Dropping the tool 10 will automatically close the throttle valve 18 thereby stopping the tool motor 15.

Figure 2:
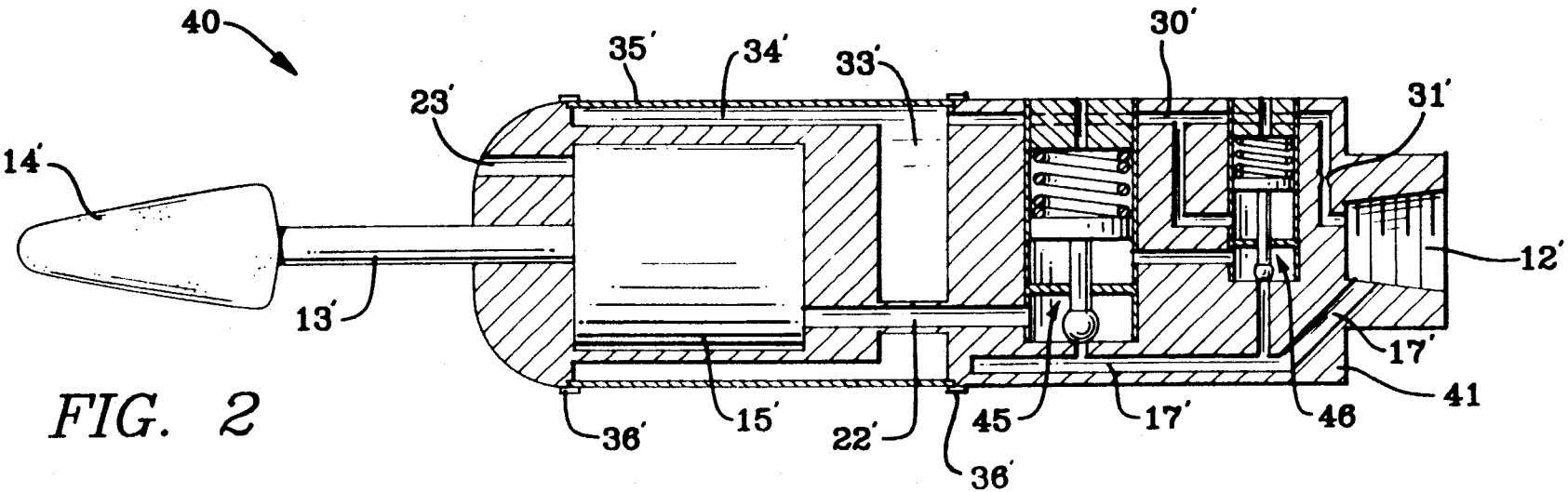
FIG. 2 is a cross section similar to FIG. 1 of a second embodiment of the tool containing a two-stage control device.
Figure 2A:
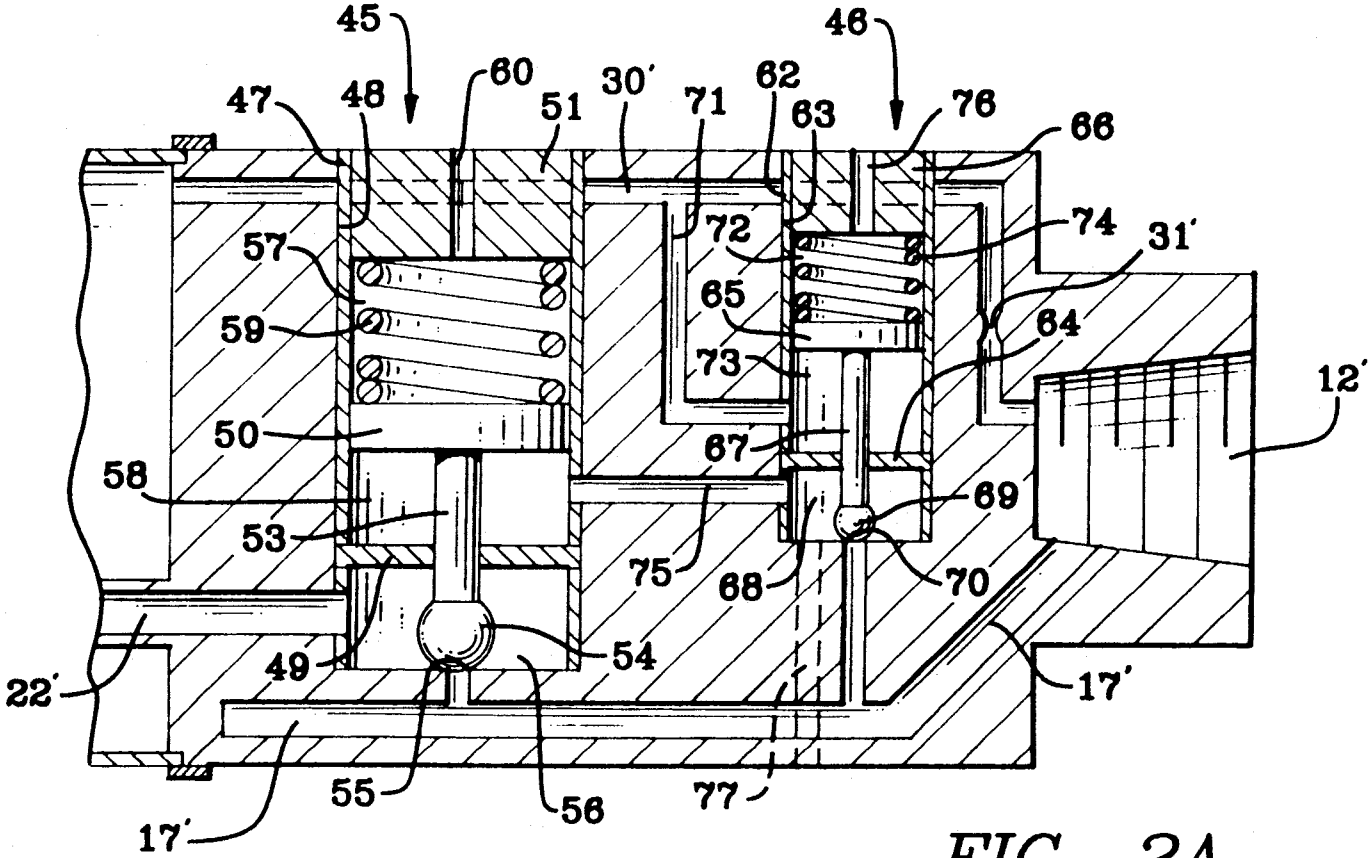
FIG. 2A is an enlarged scale view of the rear or right end portion of FIG. 2 to better illustrate the construction of portions of the control device of this embodiment.

The second embodiment of the invention shown in FIGS. 2 and 2A is essentially the same as the FIG. 1 embodiment except that it contains a second valve for controlling the valve that feeds air pressure to the tool motor. FIG. 2 illustrates a valve construction that is probably closer to that in an operative tool.

The tool 40 in FIG. 2 includes a front portion containing essentially the same parts as shown in FIG. 1 and these parts will be referred to by the same reference numbers as used in FIG. 1 plus a prime symbol to denote their use in a separate embodiment.

The tool 40 in FIG. 2 has the same external appearance as the first embodiment in FIG. 1 and includes a tool body 41 having an air inlet 12' at its rear end and a rotary shaft 13' at its front end carrying a grinding implement 14'. The rotary shaft 13' is connected to an air motor 15, contained in the tool body 41. The air inlet 12' is threaded for connection to an air hose and connects to an air inlet passage 17'. The air motor 15' receives air pressure from a motor passage 22' and is exhausted through an exhaust passage 23' located in the front of the tool body 41. An air pressure control chamber 33' is contained in the tool body 41 and connected to an air pressure outlet port 34' contained in the outer surface of the tool body 41 for exhausting air from the control chamber 33'. The outlet port 34' is covered by a screen 35' for protection and the tool body 41 carries a pair of circumferential rings 36'. The control chamber 33' is connected to a bleed passage 30' which receives air pressure at a controlled rate from the inlet 12' through an orifice 31'. The orifice 31' is sized to bleed enough air pressure to the control chamber 33' for the pressure to rise substantially when the outlet port 34' is closed and for the air pressure in the control chamber 33' to drop to atmospheric pressure when the outlet port 34' is open, in the same manner as in FIG. 1. All of the foregoing structure is the same or similar to structure found in the first embodiment shown in FIG. 1.

The tool body 41 contains two valves, a larger motor control valve 45, which can be compared to the throttle valve 18 in the first embodiment, and a secondary valve 46 controlling the motor control valve 45.

The motor control valve 45 includes a cylindrical sleeve 47 fitted inside of a bore 48 formed in the body 41. The sleeve 47 contains a fixed wall 49, a sliding piston 50 and an end plug 51. The piston 50 carries a valve rod 53 extending through a sealed hole in the fixed wall 49 and connected to a throttle valve ball 54 engaging a valve seat 55 located in a valve chamber 56 formed between the fixed wall 49 and the inner end of the bore 48. The piston 50 divides the space in the sleeve 47 located between the fixed wall 49 and the plug 51 into a spring chamber 57 and a pressure chamber 58. The spring chamber 57 contains a spring 59 urging the piston 50 toward the fixed wall 49 and the plug 51 contains a vent passage 60 for venting the spring chamber 57.

The inlet air passage 17', extending from the air inlet 12', is connected to the valve seat 55 located in the inner end of the bore 48 and opening into the valve chamber 56. The motor passage 22' extends from the valve chamber 56 to the air motor 15' for feeding air pressure from the valve chamber 56 when the valve 54 is pulled away from the valve seat 55, thus allowing air pressure in the inlet air passage 17' to flow through the valve chamber 56 and the motor passage 22' to the air motor 15'. Normally, the spring 59 urges the piston 50 in a valve closing direction. The valve 54 is opened by air pressure rising in the pressure chamber 58 to a value sufficient to overcome the force of the spring 59, which is under the control of the secondary valve 46, as explained hereinafter. The spring chamber 57 is exhausted to atmosphere by a vent passage 60 provided in the end plug 51 to prevent pressure from rising in the spring chamber 57.

The secondary valve 46 is similar in construction to the motor control valve 45 except that it is smaller since it does not have to handle as great a volume of air. It includes a cylindrical sleeve 62 fitting into a bore 63 and containing a fixed wall 64, a sliding piston 65 and an end plug 66. The piston 65 carries a valve rod 67 extending through a sealed hole in the fixed wall 64 into a valve chamber 68 and connected to a ball valve 69 engaging a valve seat 70. The piston 65 divides the space between the fixed wall 64 and the end plug 66 into a spring chamber 72 and a pressure chamber 73. The spring chamber 72 contains a spring 74 urging the piston 65 in the valve closing direction to seat the ball valve 69 against its seat 70. The bleed passage 30' is connected to the pressure chamber 73 by a passage 71 to cause the piston 65 to open the ball valve 69 when the pressure in the control chamber 33' rises sufficiently to overcome the force of the spring 74. The valve chamber 68 is connected to the pressure chamber 58 of the motor control valve 45 by a control passage 75 located between the two valves 45 and 46. The spring chamber 72 is exhausted to atmosphere by a vent passage 76 formed in the end plug 66. The valve chamber 68 is exhausted to atmosphere by a bleed passage 77 which is small enough not to affect the operation of the secondary valve 46 while avoiding the trapping of air pressure in the valve chamber 68 when the valve 46 is closed. The opening of the secondary valve 46 feeds pressure to the pressure chamber 58 in the motor control valve 45 causing that valve to open to feed pressure through the motor passage 22' to the air motor 15'.

The second embodiment in FIG. 2 containing a two-stage valve circuit is believed to provide better control over the air motor 15' than is provided by the single stage valve circuit in FIG. 1. The slight opening of the secondary valve 46 will definitely and distinctly open the motor control valve 45 to a fully open position which will remain fully open until the secondary valve 46 closes. It is believed that this circuit will reduce or eliminate any tendency of the motor control valve 45 to hunt between open and closed positions which could cause the tool to surge.

While this invention has been illustrated and described in accordance with preferred embodiments, it is recognized that variations and changes may be made therein without departing from the invention as set forth in the claims.

Having described the invention, what is claimed is:

1. A fluid driven tool having a control device comprising;

a tool body including an inlet for driving fluid;

a throttle valve in said tool body for controlling the flow of driving fluid to a tool motor and having a normally closed position;

means responsive to an increase of fluid pressure for opening said valve to cause driving fluid to flow to said tool motor;

a control chamber in said body;

an opening in said body for venting said control chamber to the atmosphere and located where it is closed by the hand of an operator normally grasping the tool body during operation;

means for connecting said chamber to said valve opening means for the pressure in said chamber to cause said valve opening means to open said valve: and means for applying fluid pressure to said chamber at a low pressure wherein the pressure in said chamber can remain at substantially atmospheric pressure when said opening is uncovered and will rise to a pressure above atmospheric when said opening is covered by the hand of an operator thereby causing said valve opening means to open the valve in said body for allowing driving fluid to flow to said tool motor.

2. The tool of claim 1 wherein the means for applying fluid to said control chamber includes a passage connected to said inlet and an orifice of predetermined size for restricting the flow of fluid from said inlet to said opening.

3. The tool of claim 2 wherein the means for opening said valve includes a piston having means urging the piston toward a valve closing position and being urged toward a valve opening position by the pressure of the fluid in said control chamber.

4. The tool of claim 2 wherein the means for opening said valve includes another valve controlled by the pressure in said control chamber.

5. The tool of claim 3 wherein the means for urging said piston toward a valve closing position is a spring.

6. The tool of claim 3 including a screen covering said opening in said body to prevent undesired objects from passing through said opening with said fluid.

7. The tool of claim 3 including means on the outer surface of said body to prevent said opening from being closed by a supporting surface when resting on said surface.

8. A power tool adapted to be held in the hand of an operator and having a control that includes a fluid port opening through the exterior of the tool body adapted to be covered by the operator's hand, said control being operative to operate a pressure responsive throttle valve, the pressure responsive throttle opening in response to an increase in applied fluid pressure, the pressure responsive throttle valve operating the tool when said port is covered by the operator's hand and stopping the tool when the port is uncovered.

9. A fluid driven tool control device comprising:

a throttle valve in the tool for controlling the flow of a driving fluid to a fluid motor;

a biasing means for biasing the throttle valve to a closed position; and a valve opening means for opening the throttle vale to cause the driving fluid to flow to the fluid motor, the valve opening means comprising: a control chamber in the tool; a vent opening in the tool for venting the control chamber to the atmosphere, the vent opening being located where it may be covered by the hand of an operator normally grasping the tool during operation, the vent opening being in fluid communication with the control chamber; a means for applying fluid pressure to the control chamber at a low pressure wherein the pressure in the control chamber can remain at substantially atmospheric pressure when the vent opening is uncovered, the substantially atmospheric pressure being insufficient to overcome the throttle valve closing biasing means and wherein the pressure in the control chamber will rise above atmospheric when the vent opening is covered by the hand of the operator, the above atmospheric pressure overcoming the throttle valve closing biasing means thereby causing the valve opening means to open the throttle valve.

10. The tool of claim 9 wherein the means for applying fluid pressure to the control chamber includes an orifice of predetermined size for restricting the flow of fluid through the vent opening.

11. The tool of claim 10 wherein the valve opening means includes a piston, the biasing means urging the piston toward a valve closed position and the piston being urged to a valve open position by the above atmospheric pressure of the fluid in the control chamber.

12. The tool of claim 10 wherein the valve opening means includes another valve controlled by the pressure in the control chamber.

* * * * *